US009951597B1

(12) United States Patent
Lin et al.

(10) Patent No.: US 9,951,597 B1
(45) Date of Patent: Apr. 24, 2018

(54) DOWNHOLE COAL SEAM PULSE DETONATION WAVE DIRECTIONAL FRACTURING PERMEABILITY-INCREASING METHOD

(71) Applicant: CHINA UNIVERSITY OF MINING AND TECHNOLOGY, Jiangsu (CN)

(72) Inventors: Baiquan Lin, Jiangsu (CN); Fazhi Yan, Jiangsu (CN); Chuanjie Zhu, Jiangsu (CN); Chang Guo, Jiangsu (CN); Quanle Zou, Jiangsu (CN); Ting Liu, Jiangsu (CN); Yidu Hong, Jiangsu (CN); Hao Yao, Jiangsu (CN)

(73) Assignee: CHINA UNIVERSITY OF MINING AND TECHNOLOGY, Jiangsu (CN)

( * ) Notice: Subject to any disclaimer, the term of this patent is extended or adjusted under 35 U.S.C. 154(b) by 0 days.

(21) Appl. No.: 15/325,662

(22) PCT Filed: Dec. 28, 2015

(86) PCT No.: PCT/CN2015/099093

§ 371 (c)(1),
(2) Date: Jan. 11, 2017

(87) PCT Pub. No.: WO2016/165396

PCT Pub. Date: Oct. 20, 2016

(30) Foreign Application Priority Data

Apr. 15, 2015 (CN) ..... 2015 1 0178282

(51) Int. Cl.
*E21B 43/26* (2006.01)
*E21B 43/30* (2006.01)

(52) U.S. Cl.
CPC ..... *E21B 43/26* (2013.01); *E21B 43/30* (2013.01)

(58) Field of Classification Search
CPC ..... E21B 43/26; E21B 43/30
(Continued)

(56) References Cited

U.S. PATENT DOCUMENTS

2012/0118395 A1 5/2012 Wang et al.
2013/0075099 A1 3/2013 Kitzman

FOREIGN PATENT DOCUMENTS

CN 102817632 A 12/2012
CN 104453827 A 3/2015
CN 104863561 A 8/2015

*Primary Examiner* — William D Hutton, Jr.
*Assistant Examiner* — Ashish K Varma
(74) *Attorney, Agent, or Firm* — Saliwanchik, Lloyd & Eisenschenk

(57) ABSTRACT

A method for permeability improvement for a downhole coal seam by directional fracturing with pulsed detonation waves, which is applicable to gas control in coal seam areas with high gas concentration and low air permeability. The permeability improvement method is as follows: first, drilling a pulsed detonation borehole and pulsed detonation guide boreholes from a coal roadway to a coal seam respectively; then, pushing a positive electrode connected to a positive output side of an explosion-proof high-voltage electrical pulse generator to the bottom of the pulsed detonation borehole and pushing a negative electrode connected to a negative output side of the explosion-proof high-voltage electrical pulse generator to the bottom of the pulsed detonation guide borehole; connecting the pulsed detonation borehole and the pulsed detonation guide boreholes to an extraction pipeline for gas extraction, after electrical pulsed detonation fracturing for the coal seam is carried out. The method disclosed in the present invention utilizes the high instantaneous energy provided by electrical pulsed detonation waves to fracture a coal mass, so as to form a fissure network in the coal mass between the pulsed detonation borehole and the pulsed detonation guide boreholes; thus,
(Continued)

the air permeability coefficient of the coal mass can be increased by 200-400 times, the effective influence scope of gas extraction of a single borehole for gas extraction can be enlarged by 3-4 times, the extracted gas volume from the borehole can be increased by 3-8 times, and the coal seam gas pre-extraction time can be shortened effectively.

3 Claims, 1 Drawing Sheet

(58) Field of Classification Search
USPC ..... 166/248
See application file for complete search history.

DOWNHOLE COAL SEAM PULSE DETONATION WAVE DIRECTIONAL FRACTURING PERMEABILITY-INCREASING METHOD

CROSS REFERENCE TO RELATED APPLICATIONS

This application is a National Stage Application of International Application Number PCT/CN2015/099093, filed Dec. 28, 2015; which claims priority to Chinese Application No. 201510178282.9, filed Apr. 15, 2015; both of which are incorporated herein by reference in their entirety.

FIELD OF THE INVENTION

The present invention relates to a method for permeability improvement for a downhole coal seam by directional fracturing with pulsed detonation waves, which is especially applicable to gas control in coal seam areas with high gas concentration and low air permeability, for the purpose of improving the gas extraction efficiency in a borehole and realize quick elimination of gas outburst in the coal seam.

BACKGROUND ART

Gas extraction is a major measure for solving a gas gush problem and preventing gas outburst in the mining process of a coal seam with high gas concentration and low air permeability. However, owing to the low air permeability of coal seams with high gas concentration and low air permeability, it is difficult to carry out gas extraction in the conventional way and the gas extraction effect is poor; hence, technical measures for pressure relief and permeability improvement are required. Coal seam fracturing and permeability improvement techniques are important means to solve the ubiquitous problems of micro-porosity, low permeability and high absorptivity in coal seams with a high gas outburst risk in China. Domestic and foreign researchers have made extensive researches on pressure relief and permeability improvement techniques for coal seams, and have obtained some results. Existing effective pressure relief and permeability improvement techniques mainly include: intensive borehole drilling, high pressure water jet slotting, deep-hole loose blasting, and hydraulic fracturing, etc. However, most of the existing techniques have drawbacks such as complex process, high construction workload, high cost, and limited range of application, etc.

CONTENTS OF THE INVENTION

Technical Problem

To overcome the drawbacks in the prior art, the present invention provides a method for permeability improvement for a downhole coal seam by directional fracturing with pulsed detonation waves, which is a directional permeability improvement technique utilizing the characteristics of instantaneous high energy and strong destructive power of pulsed detonation waves based on physical discharging and utilizing electric pulsed detonation waves, has advantages including simple process and high construction efficiency, and has a good application prospect in coal seam fracturing and permeability improvement and fissure stoppage.

Technical Solution

The method for permeability improvement for a downhole coal seam by directional fracturing with pulsed detonation waves provided in the present invention employs an explosion-proof high-voltage electrical pulse generator, and comprises the following steps:

a. drilling a pulsed detonation borehole from the wall of a roadway to a coal seam, and drilling four pulsed detonation guide boreholes around the pulsed detonation borehole, the four pulsed detonation guide boreholes are at the same distance to the pulsed detonation borehole and are parallel to each other;

b. connecting the input side of the explosion-proof high-voltage electrical pulse generator to an explosion-proof power cabinet via an explosion-proof switch;

c. connecting a positive output side of the explosion-proof high-voltage electrical pulse generator to a positive electrode through a positive electrode cable, utilizing a tube in ½" diameter to push the positive electrode to the bottom of the pulsed detonation borehole;

d. connecting a negative output side of the explosion-proof high-voltage electrical pulse generator to a negative electrode through a negative electrode cable, and utilizing a tube in ½" diameter to push the negative electrode to the bottom of the pulsed detonation guide borehole;

e. closing the explosion-proof switch to charge the explosion-proof high-voltage electrical pulse generator, and discharging from the positive electrode when the voltage of the explosion-proof high-voltage electrical pulse generator increases to a preset discharge voltage;

f. disconnecting the explosion-proof switch when the positive electrode has discharged for 20-30 times, and withdrawing the positive electrode and the negative electrode by 25 cm along the borehole;

g. repeating the steps e and f for several times, disconnecting the explosion-proof switch till the positive electrode and the negative electrode are at a 6 m distance to the wall of the roadway, and withdrawing the positive electrode and the negative electrode out of the borehole, and then connecting the pulsed detonation borehole and the pulsed detonation guide boreholes to a gas extraction pipe network for gas extraction.

The distance from the pulsed detonation borehole to each of the four pulsed detonation guide boreholes is 4-6 m.

The explosion-proof high-voltage electrical pulse generator operates at 10-50 Hz frequency and within 50-500 KV voltage range.

Beneficial effects: The method provided in the present invention utilizes pulsed detonation waves based on physical discharging for fracturing and permeability improvement for a downhole in a coal mine, arranges four pulsed detonation guide boreholes around a pulsed detonation borehole at equidistance, utilizes the characteristics of high instantaneous energy and strong destructive power of pulsed detonation waves to fracture the coal mass between the pulsed detonation borehole and the pulsed detonation guide boreholes and form networked fissures in the space, so as to improve the air permeability in the coal mass. By applying the technique of directional fracturing and permeability improvement utilizing pulsed detonation waves, the effective influence scope of gas extraction of a single borehole can be enlarged by 3-4 times, the air permeability coefficient in the coal mass around the borehole can be improved by 200-400 times, and the extracted gas volume can be increased by 3-8 times; thus, the pre-extraction time is effectively shortened, and valuable time and safety guarantee are provided for safe and efficient mining in the coal mine. The method is simple and easy to operate, and has extensive practicability in the technical field.

In the figures: 1—explosion-proof power cabinet; 2—explosion-proof switch; 3—explosion-proof high-voltage electrical pulse generator; 4—positive output side; 5—negative output side; 6—positive electrode cable; 7—positive electrode; 8—pulsed detonation borehole; 9—negative electrode cable; 10—negative electrode; 11—pulsed detonation guide borehole; 12—coal seam.

DETAILED DESCRIPTION OF THE EMBODIMENTS

Hereunder the present invention will be detailed in an embodiment with reference to the accompanying drawings.

Figure 1:
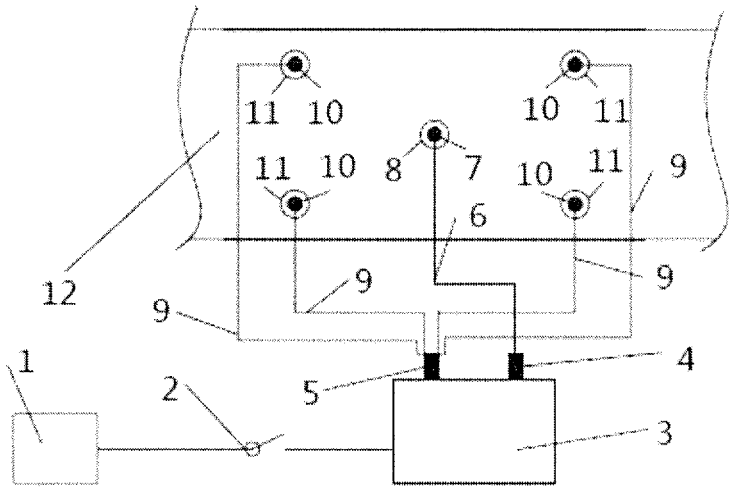
FIG. 1 is a schematic structural diagram illustrating the method for permeability improvement by directional fracturing with pulsed detonation waves according to the present invention.
Figure 2:
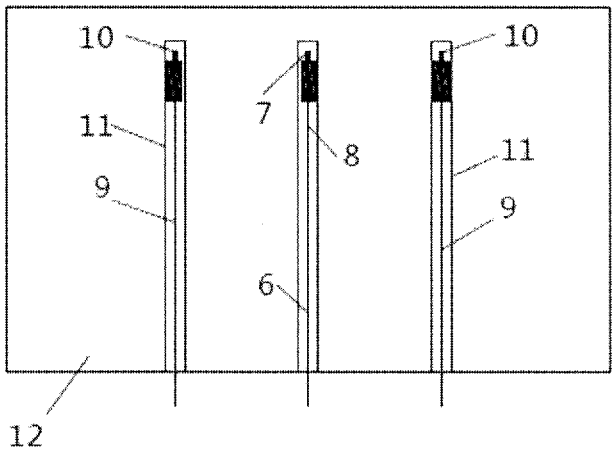
FIG. 2 is a top view of the arrangement of the pulsed detonation borehole and the pulsed detonation guide boreholes in a coal seam according to the present invention.

The method for permeability improvement for a downhole coal seam by directional fracturing with pulsed detonation waves provided in the present invention employs an explosion-proof high-voltage electrical pulse generator 3, and comprises the following steps:

(1) drilling a pulsed detonation borehole 8 from the wall of a roadway to a coal seam 12 according to FIG. 1, and then drilling four pulsed detonation guide boreholes 11 around the pulsed detonation borehole 8, the four pulsed detonation guide boreholes 11 are at the same distance to the pulsed detonation borehole 8, and are parallel to each other; the distance from the pulsed detonation borehole 8 to each of the four pulsed detonation guide boreholes 11 is 4-6 m;

(2) connecting the input side of the explosion-proof high-voltage electrical pulse generator 3 to an explosion-proof power cabinet 1 via an explosion-proof switch 2;

(3) connecting a positive output side 4 of the explosion-proof high-voltage electrical pulse generator 3 to a positive electrode 7 through a positive electrode cable 6, utilizing a tube in ½" diameter to push the positive electrode 7 to the bottom of the pulsed detonation borehole 8;

(4) connecting a negative output side 5 of the explosion-proof high-voltage electrical pulse generator 3 to a negative electrode 10 through a negative electrode cable 9, utilizing a tube in ½" diameter to push the negative electrode 10 to the bottom of the pulsed detonation borehole 11;

(5) closing the explosion-proof switch 2 to charge the explosion-proof high-voltage electrical pulse generator 3, and discharging from the positive electrode 7 when the voltage increases to 260 KV discharge voltage; the explosion-proof high-voltage electrical pulse generator 3 operates at 10-50 Hz frequency and within 50-500 KV voltage range;

(6) disconnecting the explosion-proof switch 2 when the positive electrode 7 has discharged for 20-30 times, and withdrawing the positive electrode 7 and the negative electrode 10 by 25 cm along the borehole;

(7) repeating the steps 5 and 6 for several times, disconnecting the explosion-proof switch 2 till the positive electrode and the negative electrode are at a 6 m distance to the wall of the roadway, and withdrawing the positive electrode 7 and the negative electrode 10 out of the borehole, and then connecting the pulsed detonation borehole 8 and the pulsed detonation guide boreholes 11 to a gas extraction pipe network for gas extraction.

The invention claimed is:

1. A method for improving permeability in a downhole coal seam by directional fracturing with pulsed detonation waves, the method comprising the following steps:

drilling a pulsed detonation borehole from the wall of a roadway to a coal seam, and drilling four pulsed detonation guide boreholes around the pulsed detonation borehole, wherein the four pulsed detonation guide boreholes are at the same distance to the pulsed detonation borehole and are parallel to each other;

connecting the input side of an explosion-proof high-voltage electrical pulse generator to an explosion-proof power cabinet via an explosion-proof switch;

connecting a positive output side of the explosion-proof high-voltage electrical pulse generator to a positive electrode through a positive electrode cable, utilizing a tube in ½" diameter to push the positive electrode to the bottom of the pulsed detonation borehole;

connecting a negative output side of the explosion-proof high-voltage electrical pulse generator to a negative electrode through a negative electrode cable, utilizing a tube in ½" diameter to push the negative electrode to the bottom of the pulsed detonation borehole;

closing the explosion-proof switch to charge the explosion-proof high-voltage electrical pulse generator, and discharging from the positive electrode when the voltage of the explosion-proof high-voltage electrical pulse generator increases to a preset discharge voltage;

disconnecting the explosion-proof switch when the positive electrode has discharged 20-30 times, and withdrawing the positive electrode and the negative electrode by 25 cm along the borehole;

disconnecting the explosion-proof switch till the positive electrode and the negative electrode are 6 m from the wall of the roadway, and withdrawing the positive electrode and the negative electrode out of the borehole, and then connecting the pulsed detonation borehole and the pulsed detonation guide boreholes to a gas extraction pipe network for gas extraction.

2. The method according to claim 1, wherein the distance from the pulsed detonation borehole to each of the four pulsed detonation guide boreholes is 4-6 m.

3. The method according to claim 1, wherein the explosion-proof high-voltage electrical pulse generator operates at 10-50 Hz frequency and within 50-500 KV voltage range.

* * * * *